US010721996B2

(12) United States Patent
Hayashi

(10) Patent No.: US 10,721,996 B2
(45) Date of Patent: Jul. 28, 2020

(54) PAD FOR PREVENTING FOOT DEFORMITY AND SHOE INCLUDING SAME

(71) Applicant: Mika Hayashi, Demarest, NJ (US)

(72) Inventor: Mika Hayashi, Demarest, NJ (US)

( * ) Notice: Subject to any disclaimer, the term of this patent is extended or adjusted under 35 U.S.C. 154(b) by 0 days.

(21) Appl. No.: 16/165,513

(22) Filed: Oct. 19, 2018

(65) Prior Publication Data

US 2020/0121029 A1 Apr. 23, 2020

(51) Int. Cl.

| | |
|---|---|
| ***A43B 5/00*** | (2006.01) |
| ***A43B 23/28*** | (2006.01) |
| ***A43B 7/14*** | (2006.01) |
| ***A43B 1/14*** | (2006.01) |

(52) U.S. Cl.

CPC ..... *A43B 23/28* (2013.01); *A43B 1/14* (2013.01); *A43B 7/141* (2013.01); *A43B 7/142* (2013.01); *A43B 7/149* (2013.01); *A43B 7/1445* (2013.01)

(58) Field of Classification Search

CPC ..... A43B 23/28; A43B 7/1445; A43B 7/142; A43B 7/141; A43B 7/149; A43B 1/14; A43B 7/28; A43B 17/18; A43B 17/14; A43B 17/02; A43B 7/1435; A43B 7/1425

USPC ..... 36/83, 43–44, 154

See application file for complete search history.

(56) References Cited

U.S. PATENT DOCUMENTS 4,333,472 A * 6/1982 Tager ..... A43B 7/1425 36/140
5,063,692 A * 11/1991 Suginaka ..... A43B 7/142 36/43
5,138,774 A * 8/1992 Sarkozi ..... A43B 7/14 36/159
5,611,153 A * 3/1997 Fisher ..... A43B 7/14 36/173
6,315,786 B1 * 11/2001 Smuckler ..... A43B 7/14 36/145
7,489,610 B2 * 2/2009 Fujita ..... G11B 7/0062 369/59.11
9,491,981 B2 * 11/2016 Suffolk ..... A43B 5/12
10,271,612 B2 * 4/2019 Zake ..... A43B 7/141
10,292,454 B2 * 5/2019 Omarsson ..... A61F 5/14
(Continued)

FOREIGN PATENT DOCUMENTS

CH 203662117 U 6/2014
CH 204091131 U 1/2015
(Continued)

*Primary Examiner* — Timothy K Trieu

(74) *Attorney, Agent, or Firm* — IP Business Solutions, LLC

(57) ABSTRACT

A shoe includes an upper part, an outer sole, an inner sole configured between the upper part and the outer sole and abutting the outer sole, and a pad having a tear drop shape. The pad is configured between the outer sole and the inner sole to prevent the foot from forwardly slipping. The pad includes a first longitudinal end part having a first width and a first height, and a second longitudinal end part having a second width and a second height. The second longitudinal end part is configured opposite to the first longitudinal end part. The first longitudinal end part is closer to the medial side than the second longitudinal end part. The pad includes a middle part connecting the first and second longitudinal end parts. The first width is larger than the second width, and the first height is larger than the second height.

5 Claims, 6 Drawing Sheets

(56) References Cited

U.S. PATENT DOCUMENTS

| | | | | |
|---|---|---|---|---|
| 2006/0288613 | A1* | 12/2006 | Lo | A43B 7/1415 36/44 |
| 2010/0263231 | A1* | 10/2010 | Smirman | A43B 5/1641 36/43 |
| 2011/0072685 | A1* | 3/2011 | Gutowsky, Jr. | A43B 7/142 36/44 |
| 2015/0196091 | A1* | 7/2015 | Khaitan | A43B 17/026 36/102 |
| 2017/0360147 | A1* | 12/2017 | Zake | A43B 7/141 |

FOREIGN PATENT DOCUMENTS

| | | | |
|---|---|---|---|
| JP | 2008-61960 | A | 3/2008 |
| JP | 2008-161635 | A | 7/2008 |

* cited by examiner

PAD FOR PREVENTING FOOT DEFORMITY AND SHOE INCLUDING SAME

BACKGROUND

Technical Field

The present invention relates to a pad for preventing foot deformation due to slipping inside a shoe, and further relates to a shoe including the pad.

Background Technology

Certain types of shoes are constructed in a way in which a rear part of a foot is elevated higher than a front part of the foot by having heels. This construction is not limited to female shoes, but also male shoes. As a result, the foot tends to come forward by slipping inside the shoe. The higher the heel is, the more forward the feet comes. This may cause forefoot pain, by deformity especially at 4th and 5th digits which are contracted. This is so-called Hammertoe which happens more in female feet because women wear shoes more often with higher heels in business and/or formal occasions. In addition, Hallux Valgus, Claw Tow, and Mallet Tow are caused by wearing the shoes with the high heel.

DESCRIPTION OF RELATED ART

In the past, certain products were provided to prevent the foot deformity, such as Hammertoe and Hallux Valgus. However, pads provided in the past from medical doctors were looking ugly on design-oriented shoes with high heels, not long lasting due to frictions if without covers.

Orthotics which medical doctors give or which people buy over-the-counter at pharmacies do not often fit to tight-spaced closed dress shoes and especially not fit to open shoes such as sandals. Tips of the high heels or pumps compress all toes together. Further, from the side, the toes get contractures.

In order to solve the problems above, Prior Art 1 proposed an anti-slip rib which had a T-shape arranged in a front side of a shoe and extended to cover almost entire width of the shoe. Prior Art 2 proposed an anti-skid dam which was arranged in a front side of a shoe and extended to cover almost entire width of the shoe. However, the anti-slip rib and anti-skid dam were not designed to match sulcus of a foot, resulting in giving discomfort to a user.

Prior Art 1: Chinese Utility Model Publication No. 2036621170

Prior Art 2: Chinese Utility Model Publication No. 2040911310

SUMMARY

The present invention was conceived in view of the above problems. An objective of the present invention is to provide an article which stops a foot from slipping inside a shoe and therefore prevent deformity of the foot, and also to provide a shoe with the article.

In a first aspect of the invention, a pad for preventing a foot from slipping inside a corresponding shoe having an insole with an insole length includes a first longitudinal end part, a second longitudinal end part, and a middle part. The first longitudinal end part has a first width and a first height. The second longitudinal end part has a second width and a second height, and is configured opposite to the first longitudinal end. The middle part connects the first and second longitudinal end parts. The first width is larger than the second width. The first height being larger than the second height.

In a second aspect of the invention, a shoe is formed for a heel of a foot being located higher than a toe of the foot. The shoe has a medial side and a lateral side. The shoe includes an upper part, an outer sole, an inner sole configured between the upper part and the outer sole and abutting the outer sole, and a pad having a tear drop shape. The pad is configured between the outer sole and the inner sole to prevent the foot from forwardly slipping. The pad includes a first longitudinal end part having a first width and a first height, and a second longitudinal end part having a second width and a second height. The second longitudinal end part is configured opposite to the first longitudinal end part. The first longitudinal end part is closer to the medial side than the second longitudinal end part to the medial side. The pad includes a middle part connecting the first and second longitudinal end parts. The first width is larger than the second width, and the first height is larger than the second height.

DETAILED DESCRIPTION OF PREFERRED EMBODIMENTS

Figure 1:
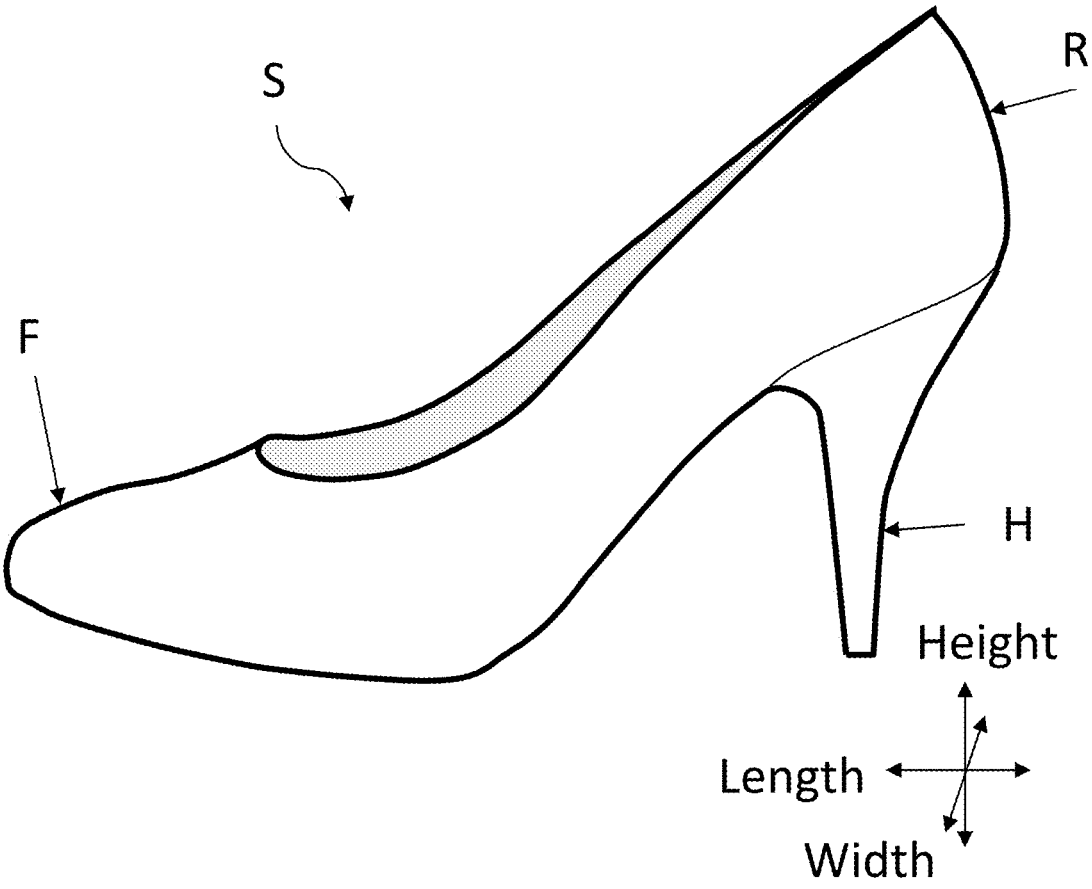
FIG. 1 is an perspective view of a typical shoe having a high heel.

In the following paragraphs, some embodiments of the invention will be described by way of example and not limitation. It should be understood based on this disclosure that various other modifications can be made by those in the art based on these illustrated embodiments.

Hereinafter, embodiments of a crest pad (or simply pad) according to the present disclosure will be described based on embodiments shown in the drawings. A size of the crest pad varies on the basis of a size of a shoe. If the shoe has a bigger size, the crest pad is supposed be bigger. In other words, the size of the crest pad should match to the size of the shoe. In the preferred embodiments below, the crest pad is described under a condition that the crest pad corresponds to the shoe.

FIG. 1 is a perspective view of the shoe S having a high heel H. The shoe S has a front part F to which a toe of a user is inserted, while the shoe has a rear part R in which a heel of the user is accommodated. For convenience purposes and better understanding, directions are defined as a length direction, a width direction, and a height direction indicated by arrows in FIG. 1.

Figure 2A:
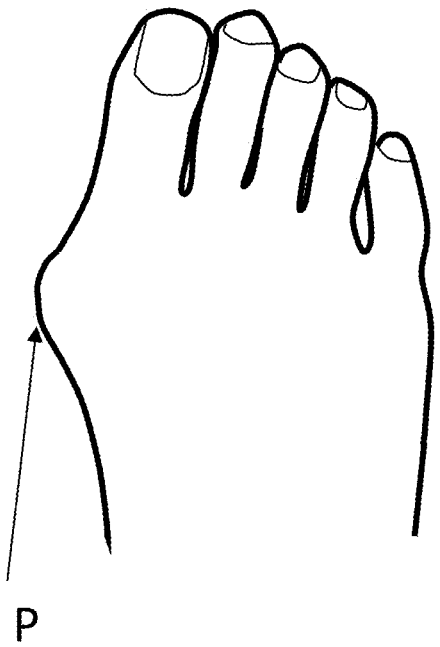
FIG. 2A is a plane view of a deformed foot as a result of wearing a shoe with a high heel.
Figure 2B:
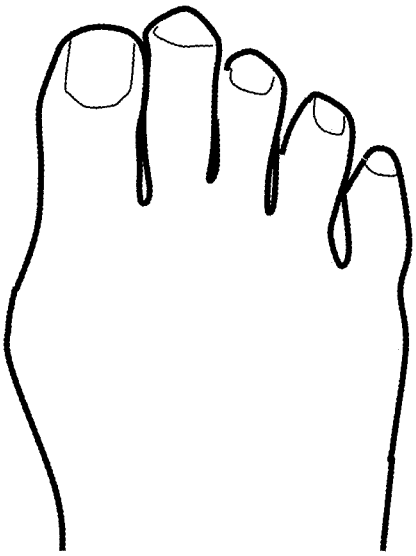
FIG. 2B is a plane view of a normal foot.
Figure 2C:
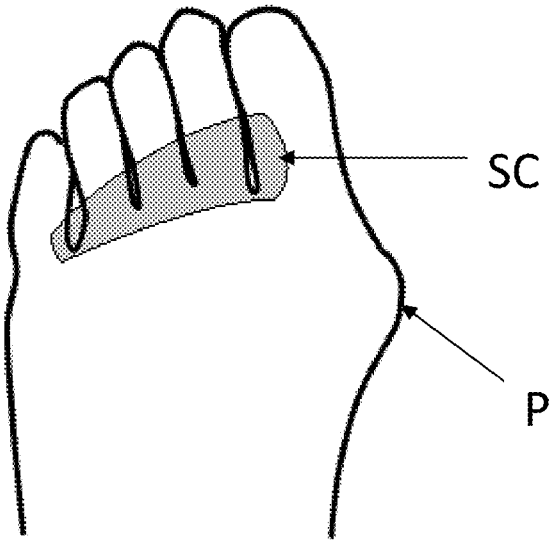
FIG. 2C is a plane view of a bottom side of a foot.

FIG. 2A is a plane view of a deformed right foot as a result of wearing a shoe with a high heel which does not fit. FIG. 2B is a plane view of a normal right foot. The deformity including Hammertoe and Hallux Valgus is caused by disposition. Namely, forwardly slipping in the shoe causes the deformity. FIG. 2C is a flip side of FIG. 2A, showing a bottom of the right foot. Sulcus SC is a groove or space formed at around a base of the fingers.

When the foot is slipped towards the front part F of the shoe S which does not fit to the foot, a first metatarsal bone of the foot is bent. This results in a joint of a base of a toe protruding. The protrusion P is in contact against the shoe, causing a pain. It is common for women wearing the shoe S with a high heel H. Especially, when the heel H of the shoe S is high, and the user wears the shoe S for long time, it will cause the pain.

FIG. 2A depicts a typical example of the deformed foot of Hallux Valgus. The deformed foot is bent especially at a base of the big toe towards a little finger. The protrusion P is noticeable, when the deformed foot is compared with the normal foot in FIG. 2B.

Figure 3A:
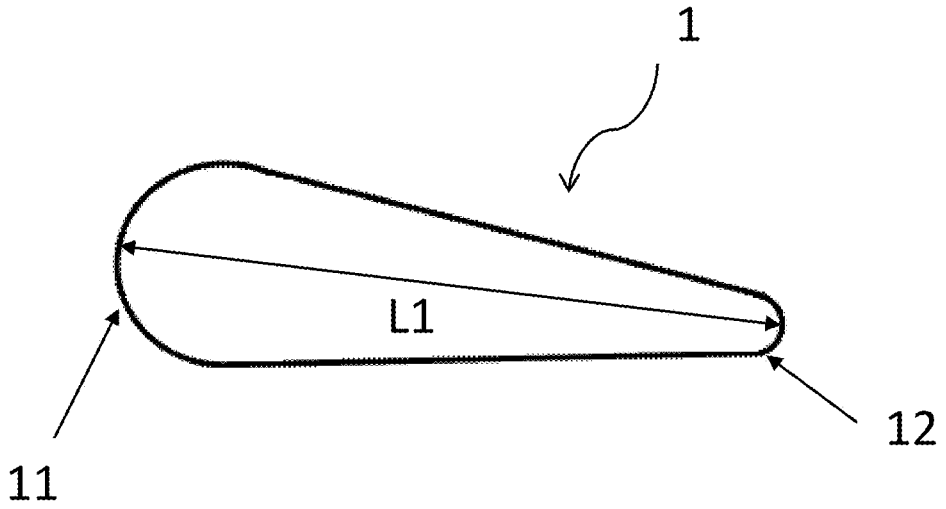
FIG. 3A is a plane view of one example of a crest pad.

In order to prevent or ease the pain caused by the foot slipping forward in the shoe S, the crest pad 1 is provided. The crest pad 1 in FIG. 3A is one example which is formed in a tear drop shape. In other words, the crest pad 1 has one longitudinal end (first longitudinal end) 11 having a larger width and the other longitudinal end (second longitudinal end) 12 having a smaller width and extends to a length L1. The one longitudinal end and the other longitudinal end are connected by a middle part (MP). Because the crest pad has the tear drop shape, it fits to the sulcus SC of the foot. The sulcus SC of the foot is a space which is formed at around proximal phalanxes, and thus is not in contact with a flat surface.

The crest pad 1 can be embedded in the shoe S, namely underneath an insole IS, but also can be provided as a separate part which the user applies to the insole IS of the shoe S. The crest pad 1, 2 which is separately prepared includes an application surface on a bottom. The application surface is bonded to the inner sole of the shoe S.

Figure 3B:
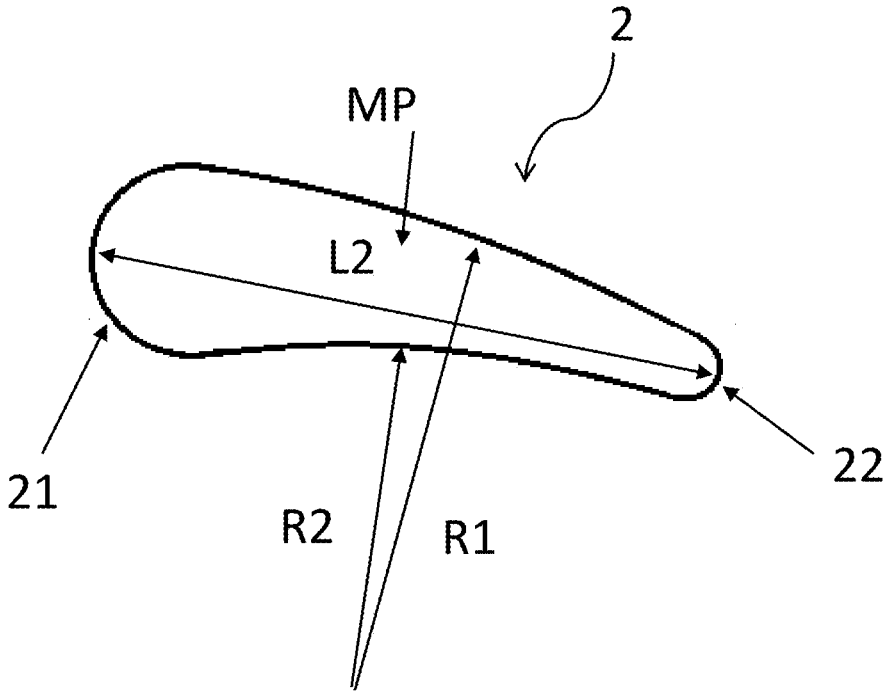
FIG. 3B is a plane view of another example of the crest pad.

A crest pad 2 is another example shown in FIG. 3B. The crest pad 2 also has a tear drop shape which is bent in one direction. In other words, part of one side of the crest pad 2 is curved with a first radius R1, and part of the other side of the crest pad 2 is curved with a second radius R2 smaller than the first radius R1. The crest pad 2 has one longitudinal end 21 having a larger width and the other longitudinal end 22 having a smaller width. A length L2 of the crest pad 2 is measured in a straight line from the one longitudinal end 21 to the other longitudinal end 22.

The crest pad 2 can be embedded in the shoe S, namely underneath an insole IS, but also can be provided as a separate part which the user applies to the insole IS of the shoe S.

Figure 4:
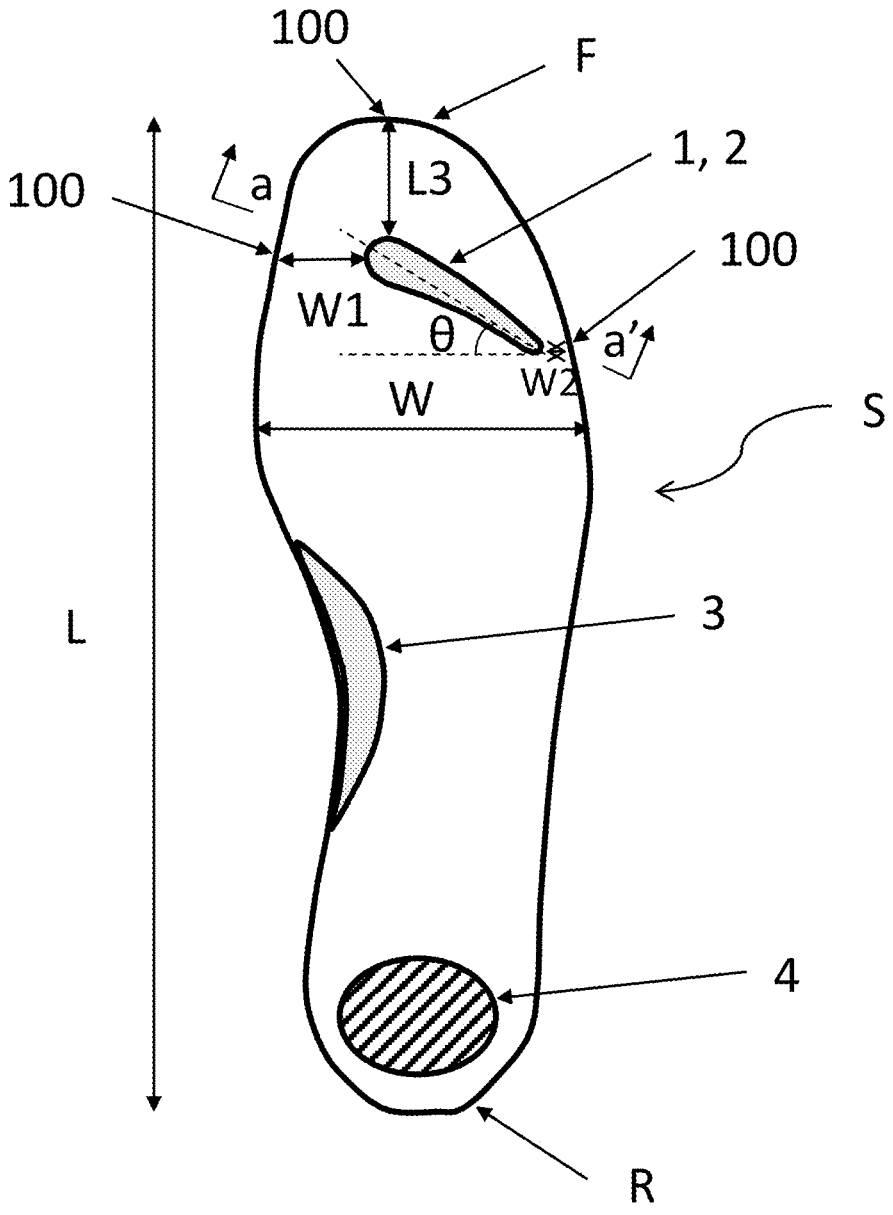
FIG. 4 is a plane view of an inside of the shoe with the crest pad, an arch lift, and a concave at a heel of the foot.

FIG. 4 is a plane view of an inside of the shoe with the crest pad 2, an arch lift 3, and a concave 4 at a heel of the foot. The arch lift 3 is also provided inside the shoe S to support an arch of the foot. The concave 4 is arranged at a vicinity of the rear end R. The heel of the user is accommodated in the concave 4. Both the arch lift 2 and the concave 4 assist preventing the foot from slipping inside the shoe S.

The crest pad 1, 2 is made of resin including Polyurethane and Ethylene-Vinyl Acetate (EVA). The crest pad 1, 2 can be also made of Foam Latex, PORON® cellular urethane, or PLASTAZOTE® urethane.

A distance from a front end to a rear end of the shoe S is the largest, and is defined as a length L. A width W of the shoe S is the largest at around an area of an instep, while the width extends in a direction perpendicular to a direction of the length L. The crest pad 1, 2 is arranged to have an angle θ in a range of 40 to 45 degree towards the direction of the width W.

The crest pad 1, 2, when embedded in the shoe S, is arranged in the vicinity of the front part F with a distance L3 away from a front end (periphery 100) of the shoe S. L3 is in a range between 10 and 20% of the length L, preferably 12.5%. Also, a distance W1 from the left side (or medial side, the periphery 100) of the shoe S in FIG. 4 is in a range between 0 and 20% of the length L. A distance W2 from a right side (or lateral side, the periphery 100) of the shoe S in FIG. 4 is in a range between 0 and 20% of width W.

Figure 5:
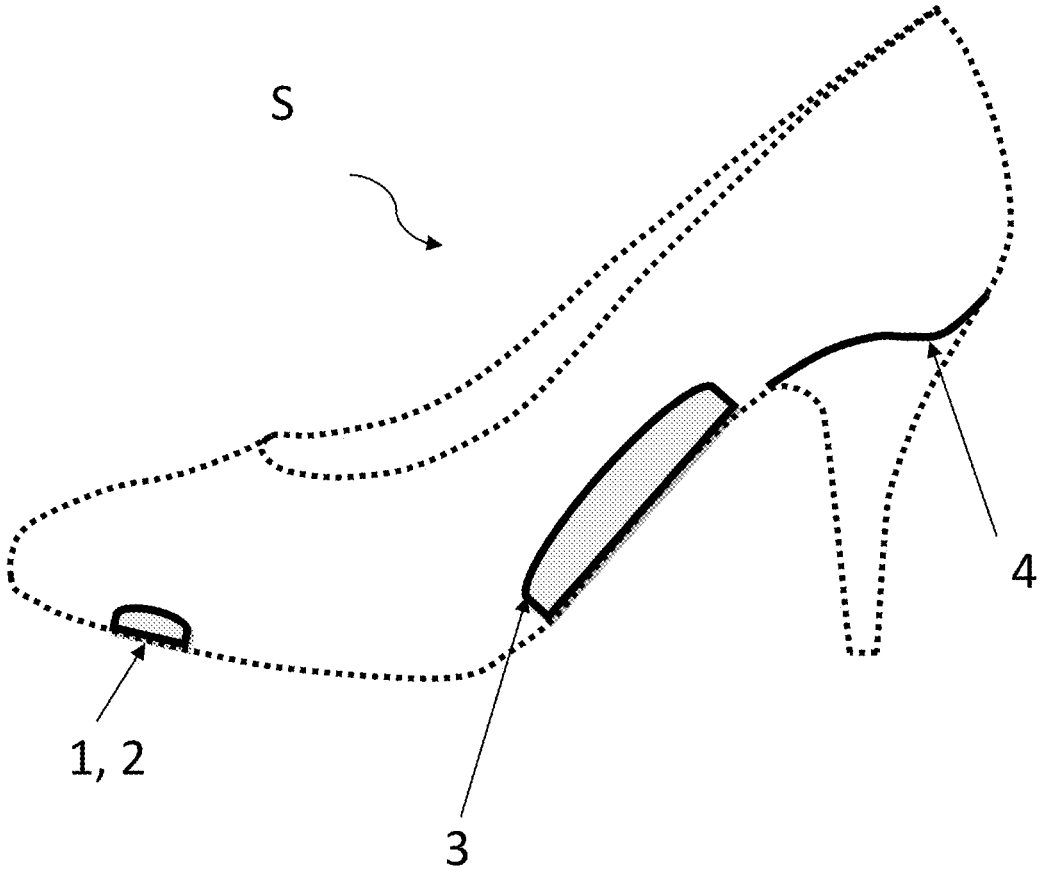
FIG. 5 is a perspective view of the shoe with the crest pad, the arch lift, and the concave.

FIG. 5 is a perspective view of the shoe with the crest pad 1, 2, the arch lift 3, and the concave 4. The arch lift 3 is arranged between the crest pad 1, 2 and the concave 4, and is formed in an arch shape to support the arch of the foot. The concave 4 is a concave to hold the heel of the foot such that the slipping towards the front part F is prevented or at least diminished.

Figure 6:
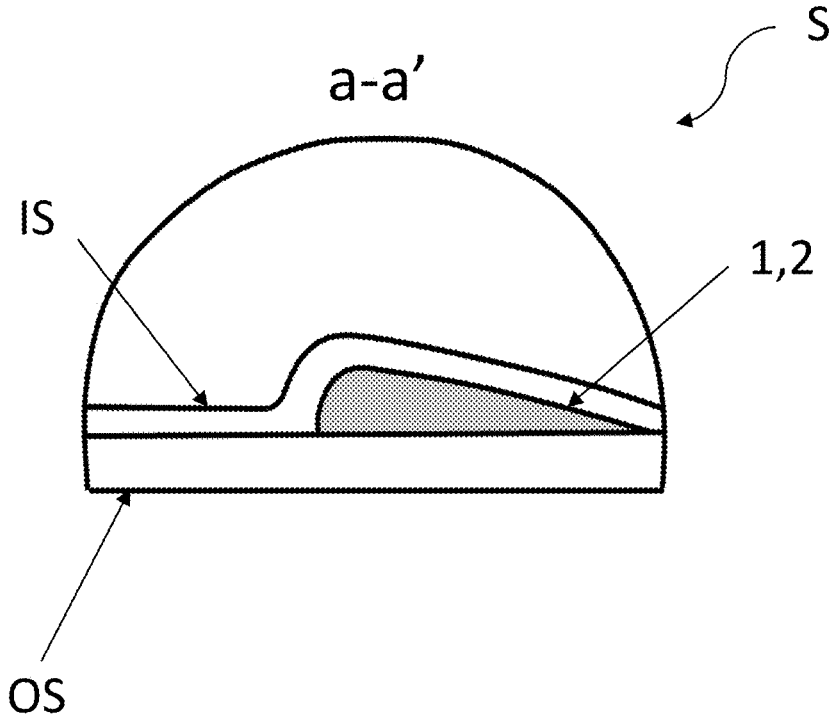
FIG. 6 is a cross-sectional view of a-a' line in FIG. 4.

FIG. 6 is a cross-sectional view of a-a' line in FIG. 4. The crest pad 1, 2 is decreasing a height as it extends towards the right side (or lateral side) of the shoe S in FIG. 6. This shape fits to the sulcus better.

What is claimed is:

1. A shoe which is formed for a heel of a foot being located higher than a toe of the foot, the shoe having a medial side and a lateral side, the shoe comprising: an upper part; an outer sole; an inner sole configured between the upper part and the outer sole and abutting the outer sole; and a pad having a tear drop shape, the pad being configured between the outer sole and the inner sole to prevent the foot from forwardly slipping, the pad including a first longitudinal end part having a first width and a first height, a second longitudinal end part having a second width and a second height, and being configured opposite to the first longitudinal end part, the first longitudinal end part being closer to the medial side than the second longitudinal end part to the medial side, and a middle part connecting the first and second longitudinal end parts, the first width being larger than the second width, the first height being larger than the second height;

wherein a length of the shoe is measured in a longitudinal direction from a front end and a rear end of the shoe, and a first distance measured in the longitudinal direction from the first longitudinal end part to a periphery of the shoe is in a range between 10% and 20% of the length of the shoe; wherein a width of the shoe is measured in a width direction being perpendicular to the longitudinal direction, and a second distance measured in the width direction from the first longitudinal end part to the periphery of the shoe is in a range between 0 and 20% of the width; wherein a third distance measured in the width direction from the second longitudinal end part to the periphery of the shoe is in a range between 0 and 20% of the width; wherein a length of the pad is in a direction from the first longitudinal end part to the second longitudinal end part, and the direction of the length of the pad makes an angle between 40 and 45 degree with respect to the width direction; further comprising an arch lift configured at a middle of the medial side to support an arch of the foot, and the insole has a concave at a rear end of the shoe to support the heel of the foot.

2. The shoe according to claim 1, wherein the pad is made of Polyurethane.

3. The shoe according to claim 1, wherein the pad has a length between 5 and 6 cm.

4. The shoe according to claim 1, wherein the first distance is 12.5 of the length of the shoe.

5. The shoe according to claim 1, wherein the pad has a first longitudinal side and a second longitudinal side being opposite to the first longitudinal side, the first longitudinal side is at least partially curved with a first radius, the second longitudinal side is at least partially curved with a second radius, the first radius is larger than the second radius.

* * * * *